US008183953B2

(12) United States Patent
Chawla et al.

(10) Patent No.: US 8,183,953 B2
(45) Date of Patent: May 22, 2012

(54) MULTI-JUNCTION STRIPLINE CIRCULATORS

(75) Inventors: Parmeet Singh Chawla, Montreal (CA); Nikolay Volobuev, Pierrefonds (CA); Yong Ju Ban, Pierrefonds (CA)

(73) Assignee: SDP Telecom Inc., Quebec (CA)

( * ) Notice: Subject to any disclaimer, the term of this patent is extended or adjusted under 35 U.S.C. 154(b) by 99 days.

(21) Appl. No.: 12/839,858

(22) Filed: Jul. 20, 2010

(65) Prior Publication Data

US 2011/0068877 A1 Mar. 24, 2011

(51) Int. Cl.
*H01P 1/387* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,286,201 | A | 11/1966 | Roberts | |
| 3,758,878 | A | 9/1973 | Wainwright | |
| 4,276,522 | A | 6/1981 | Coerver | |
| 4,791,389 | A | 12/1988 | Wolfert | |
| 4,810,979 | A | 3/1989 | Mörz et al. | |
| 5,185,587 | A | 2/1993 | Kurian et al. | |
| 5,347,241 | A | 9/1994 | Panaretos et al. | |
| 6,633,205 | B2 | 10/2003 | Jussaume et al. | |
| 6,822,524 | B2 | 11/2004 | Hempel et al. | |
| 7,382,209 | B2 * | 6/2008 | Watanabe | 333/1.1 |
| 7,385,454 | B2 | 6/2008 | Kingston et al. | |
| 7,495,521 | B2 * | 2/2009 | Chen et al. | 333/1.1 |

OTHER PUBLICATIONS

Bosma, H., "On Stripline *Y*-Circulation at UHF", IEEE Transactions on Microwave Theory and Techniques, Jan. 1964, pp. 61-72.

Fay, C.E., et al., "Operation of the Ferrite Junction Circulator", IEEE Transactions on Microwave Theory and Techniques, Jan. 1965, pp. 15-27.

Simon, J.W., "Broadband Strip-Transmission Line *Y*-Junction Circulators", IEEE Transactions on Microwave Theory and Techniques, May 1965, pp. 335-345.

* cited by examiner

*Primary Examiner* — Stephen Jones

(74) *Attorney, Agent, or Firm* — McDermott Will & Emery LLP

(57) ABSTRACT

A multi-junction stripline circulator, comprising a housing with a cavity structure and a plurality of stripline junction circuits stacked within the cavity structure and connected in a cascade arrangement. Each stripline junction circuit comprises a stripline conductor having a plurality of ports, where one of the ports is connected to a port of a stripline conductor of each consecutive junction circuit in a cascade arrangement, and a pair of ferrite elements sandwiching the stripline conductor therebetween. The multi-junction stripline circulator further comprises one or more center ground planes, each having radial arms connected to ground. Each of the center ground planes are disposed between two consecutive stripline junction circuits in said cascade arrangement. Finally, the multi-junction stripline circulator also comprises a mutually shared magnetic biasing system provided within the cavity structure and magnetically biasing all the ferrite elements of the stripline junction circuits along a same direction.

16 Claims, 8 Drawing Sheets

MULTI-JUNCTION STRIPLINE CIRCULATORS

FIELD OF THE INVENTION

The present invention relates to microwave ferrite devices. More particularly, it relates to a multi-junction stacked stripline cascade circulator that provides high isolation performance in a compact stacked configuration of a cascade of a plurality of stripline circuits.

BACKGROUND OF THE INVENTION

A microwave ferrite junction circulator is quite the versatile microwave device—it can be used as a circulator, isolator or a switch. The three-port microwave ferrite junction circulator, also referred to as a Y-junction circulator, is one of the most commonly used junction circulators. It is a three-port non-reciprocal device, which provides routing for forward signals and re-routing (with suppression) for reverse signals.

A typical single junction circulator/isolator includes a stripline conductor circuit, described as a centre conductor enveloped with a ferrite material which is biased by a magnetic system to provide the desired non-reciprocal operation. The circulation of the signals, clockwise or counter-clockwise, is achieved and controlled by the biasing magnetic field generated by the magnetic system.

An example of a single junction circulator is shown in FIG. 1*a* (PRIOR ART). The isolation of a circulator is directly correlated to (and usually the same as) the return loss of the isolated port. The conventional design of a stripline conductor circuit used in a three-port junction circulator has three ports and impedance matching provided by a quarter-wave transformer in each port to attain a typical return loss of 20 dB. When operating as an isolator, port 3 of the three-port junction circulator is connected to a resistive load to suppress the reverse signals re-routed from port 2—as seen in the exemplary embodiment of a single junction isolator of FIG. 1*b* (PRIOR ART). Hence, in known prior art devices (circulator or isolator), the stripline conductor circuit is usually designed to match the impedance of the port to that of the transmission line or resistive load.

Increasing demands for a higher level of isolation between the input and output signals in modern wireless systems and sub-systems severely limits the isolation performance achievable from a single junction circulator. In many systems used for high radio frequency (RF) power applications, for example in transmit modules for communication networks or equipment, the typical ~20 dB level of isolation is not sufficient to provide the required isolation between forward and reflected or reverse signals. Electrical properties of a typical single junction isolator are:

insertion loss: ~0.25 dB
isolation: ~20 dB
return loss: ~20 dB
bandwidth: ~3 to 5%.

Therefore, single-junction circulators are often combined together sequentially, connected serially in a coplanar adjacent configuration either side-to-side or end-to-end to attain a higher overall isolation—the higher overall isolation resulting from the additive sum of the isolation provided by each single-junction circulator. Many microwave ferrite circulators with such a sequential configuration are known. FIG. 2*a* (PRIOR ART) shows a schematic of two cascaded single junction circulators in a sequential coplanar configuration used to construct a dual or double junction circulator/isolator.

Conventionally, as shown in FIG. 2*b* (PRIOR ART), a double junction isolator 20 includes a body housing 42 having two communicating cylindrical cavities 44 arranged adjacent to each other for holding their individual stripline conductor circuits 46 serially connected as one in an abreast coplanar configuration, ferrite elements 14 that are magnetically biased by the magnets 16, and an electrical ground plane provided by pole pieces 18 in a stacked assembly. As can be seen from FIG. 2*b* (PRIOR ART), such a double junction circulator/isolator is at least double the physical size of a single junction circulator/isolator and adds to the complexity of the construction of the body housing needed to accommodate two cylindrical cavities in a side-by-side configuration. Furthermore, each ferrite element 14 associated with the stripline conductor circuit 46 in each cylindrical cavity 44 requires a separate magnet 16 to provide the required bias for the operation of the double junction circulator. For this reason, in such a conventional double junction circulator/isolator 20 as shown in FIG. 2*b* (PRIOR ART), a separate and individual magnetic biasing system has to be established in each cylindrical cavity to provide the required bias to the respective ferrite element. For such a double junction microwave ferrite circulator, the isolation provided by each single junction will still be typically ~20 dB, but the input and output ports of the circulator/isolator will now be protected by an isolation level of at least 40 dB in the case of reverse signals.

Depending on the isolation required, two, three or more single-junction circulators may be sequentially connected together. However, increasing the number of sequentially-connected circulators generally increases the physical footprint size, the number of components, the total weight and the complexity of the assembly of such a microwave ferrite circulator device, and hence substantially increases the cost of the circulator device. Presently, a typical double junction circulator/isolator device costs at least twice as much as a single junction circulator/isolator. Moreover, while single junction isolators are sequentially connected together to improve isolation performance, the drawback of such a connection is the increase in insertion loss of such a ferrite device. For example, a typical insertion loss for a sequential double junction circulator/isolator is typically ~0.5 dB as compared to 0.25 dB for a single junction circulator/isolator, which consequently reduces the level of the forward signal of microwave energy routed by this circulator/isolator by a factor of 12%, decreasing overall power handling capability and output efficiency.

Apart from the insertion loss incurred in the path of the signal within the stripline conductor circuit in a circulator/isolator, the other known major loss contributor is the conductor loss in the cylindrical cavity structure. In order to achieve high isolation performance by serially connecting stripline conductor circuits as in FIG. 2*a* (PRIOR ART) for the construction of a conventional double junction circulator/isolator device 20, multiple cylindrical cavities 44 have to be employed to house the stacked assembly of components (stripline conductor circuits, ferrite elements, magnets, electrical ground planes) needed for the operation of the double junction circulator, thus contributing significantly towards the increase in overall insertion loss.

In general, the physical footprint and volume is proportional to the cost of the required housing. In conventional well-known microwave ferrite junction circulator/isolator devices, the physical footprint contributes anywhere from 20% to upwards of 50% of the total cost. Hence, high isolation performance should be achieved within the smallest feasible physical footprint and volume.

U.S. Pat. No. 5,347,241 (PANARETOS et al) describes a dual-junction circulator based on back-to-back four-port microstrips. A microstrip includes a conducting strip separated from a single ground plane by a dielectric substrate. The device of PANARETOS includes two single junction microstrip circulators whose substrates do not lie in coplanar fashion but in a back-to-back fashion interconnected with a coaxial feedthrough that runs through both substrates and ground plane. Although the back-to-back configuration may be used to reduce the physical footprint area, the physical footprint is still greater than that of conventional single junction stripline circulators. Furthermore, the use of coaxial interconnects increases the overall volume (size) of the dual-junction circulator. The back-to-back configuration of the microstrip circulators also results in several limitations in the device of PANARETOS. Firstly, it can only be used for a dual-junction unit, and cannot be extended to a multi-junction device. Secondly, the magnetic system in the device of PANARETOS is relatively complex to provide the magnetic bias required for non-reciprocal operation of the dual-junction microstrip circulator. In one embodiment, as shown in FIG. 3*a* (PRIOR ART), PANARETOS uses a common magnet 16 for both the circulators, but such a mutual magnetic biasing system can only magnetize the ferrite element 14 of each circulator in opposite directions for the operation (i.e. when one microstrip circulator has counter-clockwise circulation, the other microstrip circulator will only circulate clockwise). In another embodiment as shown in FIG. 3*b* (PRIOR ART), two magnets 16 are used to magnetize the ferrite element 14 of each circulator which require same magnetic orientation for the operation. Magnetic shielding 50 is therefore required to reduce the interaction between the magnets 16 of the two separate magnetic biasing systems, henceforth limiting the operation of such a circulator to below ferrimagnetic resonance region. Finally, in both embodiments of U.S. Pat. No. 5,347,241 the magnetic return path from the magnetized ferrite element 14 of each circulator cannot provide a homogenous magnetic field for its operation, which limits the electrical performance and ferrimagnetic region of operation.

Accordingly, there is a need for a microwave ferrite circulator/isolator with high isolation performance, low insertion loss and a compact physical configuration.

SUMMARY OF THE INVENTION

In accordance with one aspect of the invention, there is provided a multi-junction stripline circulator that comprises a housing comprising a cavity structure and a plurality of stripline junction circuits stacked within the cavity structure and connected in a cascade arrangement. Each stripline junction circuit comprises a stripline conductor having a plurality of ports, wherein one of the ports is connected to a port of a stripline conductor of each consecutive junction circuit in the cascade arrangement, and a pair of ferrite elements sandwiching the stripline conductor therebetween. The multi-junction stripline circulator further comprises one or more center ground plane each having radial arms connected to ground. Each of said center ground planes are disposed between two consecutive stripline junction circuits in the cascade arrangement. The multi-junction stripline circulator finally comprises a mutually shared magnetic biasing system provided within the cavity structure and magnetically biasing all the ferrite elements of the stripline junction circuits along a same direction.

In accordance with another aspect of the invention there is provided a dual-junction stripline circulator that comprises a housing comprising a cavity structure and input and output stripline junction circuits stacked within the cavity structure and connected in a cascade arrangement. Each stripline junction circuit comprises a stripline conductor and a pair of ferrite elements sandwiching the stripline conductor therebetween. The stripline conductor of the input stripline junction circuits has a first port defining an input interface, a second port connected to the output stripline junction circuit and a third port terminated to a matched load. The stripline conductor of the output stripline junction circuit has a first port connected to the second port of the input stripline junction circuit, a second port defining an output interface and a third port terminated to a matched load. The dual-junction stripline circulator further comprises a center ground plane disposed between the two stripline junction circuits, the center ground plane having radial arms connected to ground. Finally, the dual-junction stripline circulator comprises a mutually shared magnetic biasing system provided within the cavity structure and magnetically biasing all the ferrite elements of the stripline junction circuits along a same direction. The mutually shared magnetic biasing system comprises a bottom magnet disposed at the bottom of the cavity structure and a top magnet disposed on top of the cavity structure.

Preferably, the multi-junction stripline circulator and dual-junction stripline circulator both include a standard resistive load connected to a port of each of the stripline conductor circuits for suppressing re-routed reverse signals according to the power handling requirements of the cascaded stages.

Advantageously, the multi-junction stripline circulator and dual-junction stripline circulator reduce the physical and mechanical footprint while providing high isolation performance and low insertion losses. Also advantageously, the cavity structure of the multi-junction stripline circulator and dual-junction stripline circulator has a compact configuration with a physical footprint area of a conventional single-junction circulator and can make use of standard single-junction circulator components to provide the scaled-up high isolation performance.

Other features and advantages of the present invention will be better understood upon a reading of preferred embodiments thereof with reference to the appended drawings.

BRIEF DESCRIPTION OF THE DRAWINGS

For a better understanding of the invention and to show how the same may be carried into effect, reference is now made by way of example to the accompanying drawings in which.

DETAILED DESCRIPTION OF THE INVENTION

In accordance with one aspect of the present invention, there is provided a multi-junction stripline circulator. The multi-junction stripline circulator can be used as a circulator or an isolator that provides high isolation performance and low insertion loss in a compact configuration. A variety of circulation paths for routing and re-routing signals are possible with the present invention.

Figure 5A:
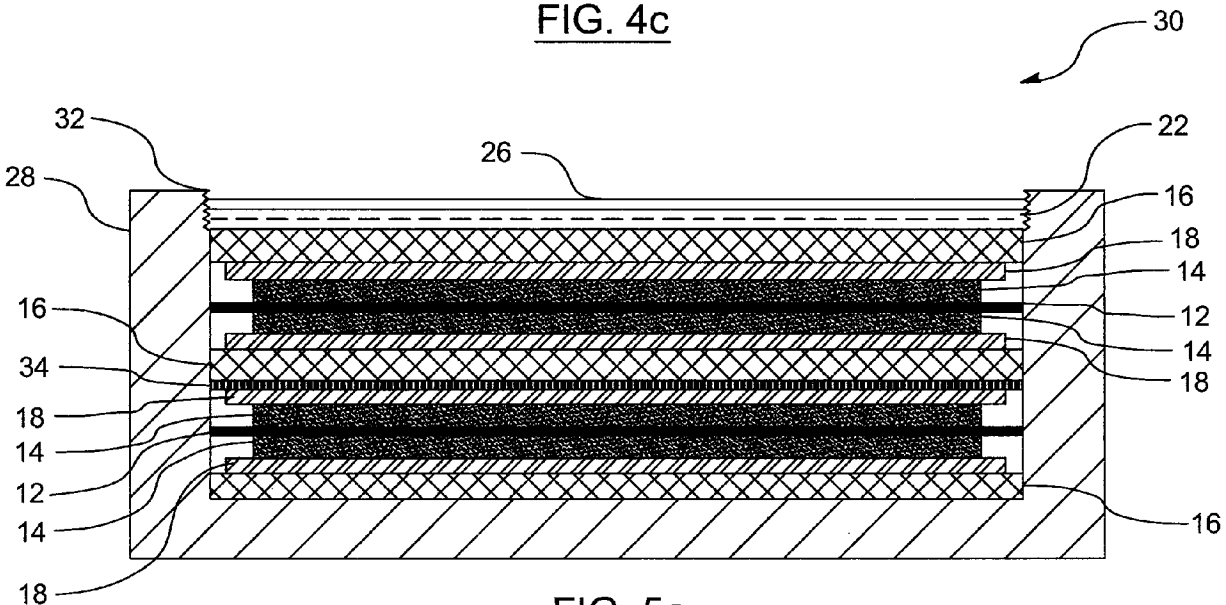
FIG. 5*a* is a cross-sectional view of the stacked assembly of a dual-junction circulator according to an embodiment of the present invention.
Figure 5B:
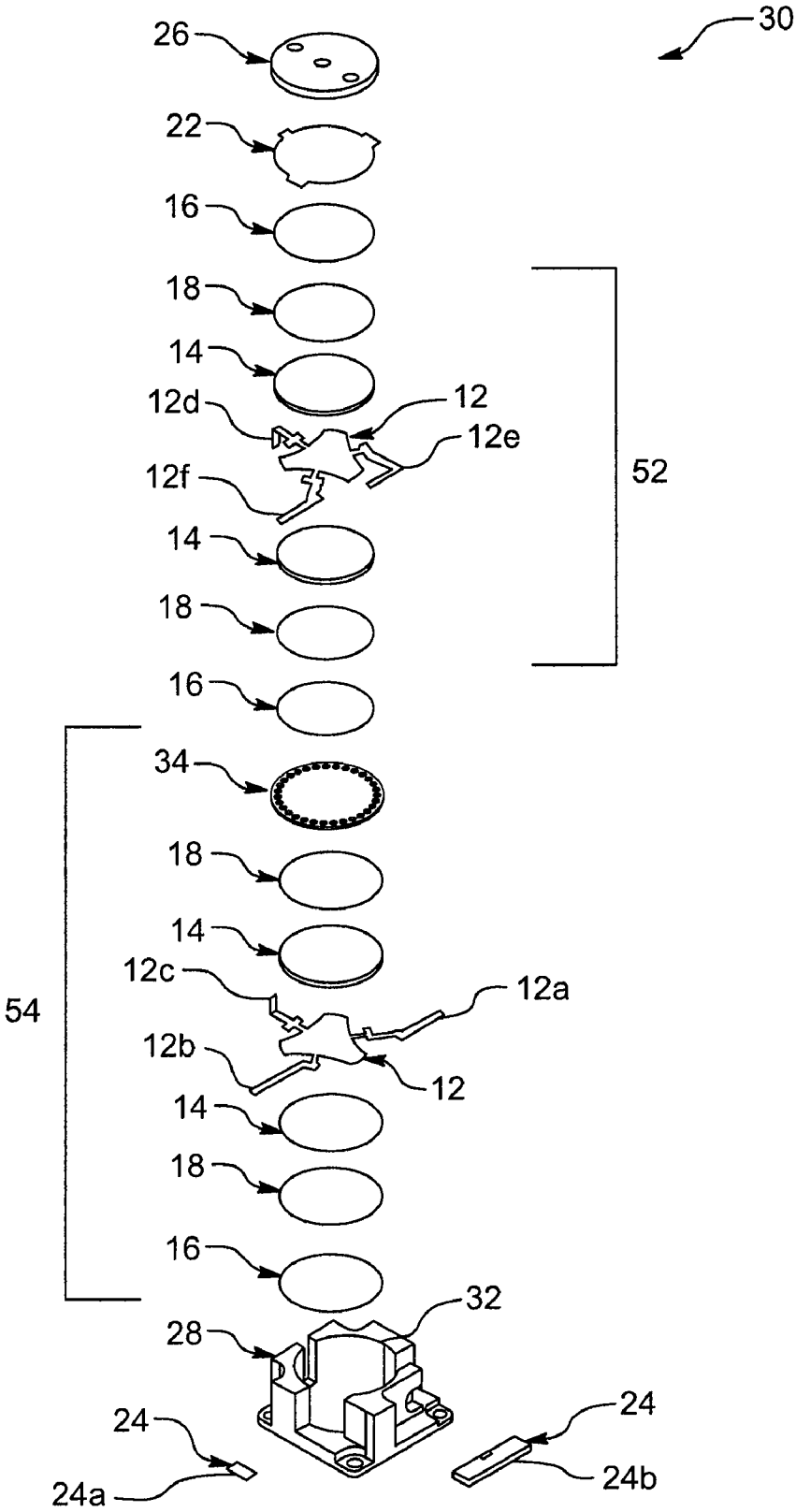
FIG. 5*b* is an exploded perspective view of a dual-junction stripline circulator according to an embodiment of the present invention.
Figure 6A:
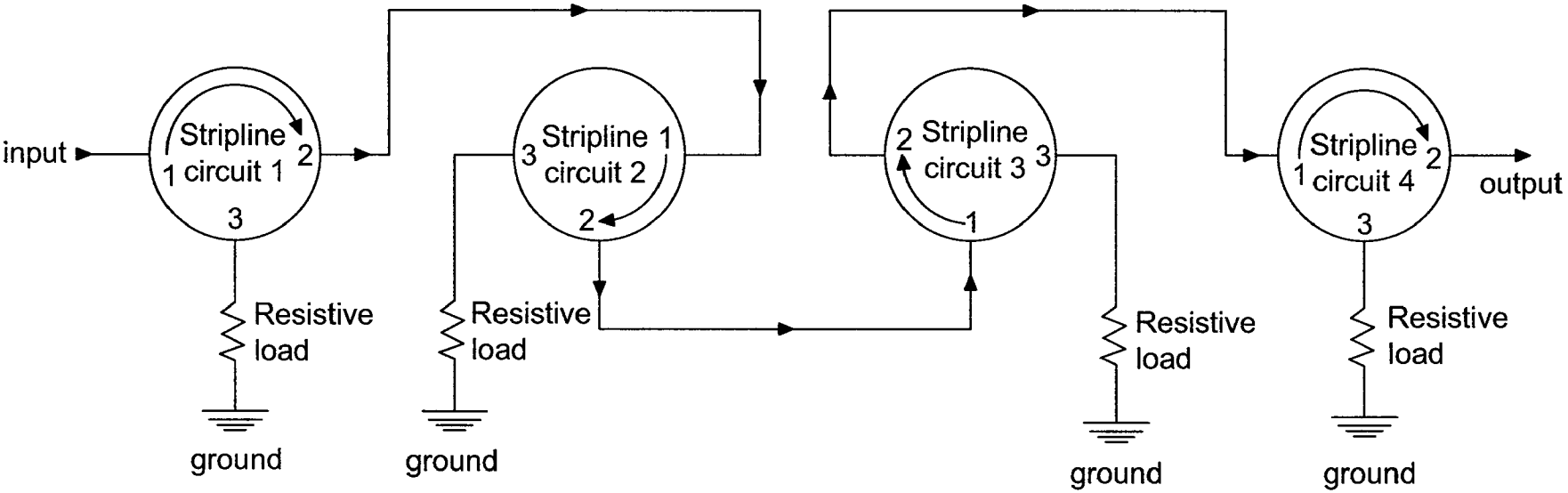
FIG. 6*a* is a schematic illustration of a multi-junction stripline circulator according to an embodiment of the present invention, showing the connections between ports of successive stripline conductor circuits.
Figure 6B:
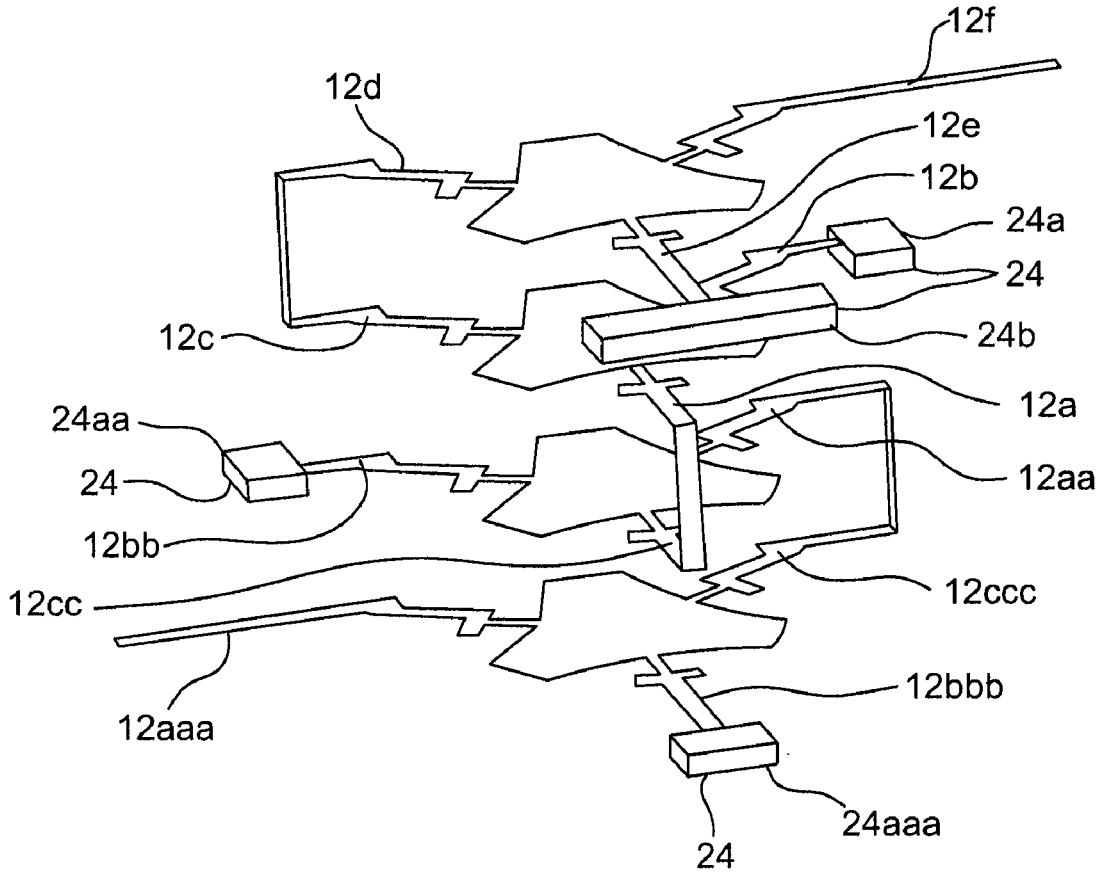
FIG. 6*b* is a perspective view of the multi-junction stripline circulator of FIG. 6*a*.

Referring to FIGS. 5*b*, 6*a* and 6*b*, a multi-junction stripline circulator 30 according to one embodiment of the invention is shown. Although FIG. 5*b* represents a dual-junction stripline circulator, one skilled in the art will easily understand that this figure can also be representative of a multi-junction stripline circulator by the simple addition of one or more sequence of elements comprised between the bracket labeled 54, provided in the same order as they currently stand. The additional sequence of elements could be provided either above or below the present elements of the bracket labeled 54.

The circulator 30 comprises a housing 28 with a cavity structure 32. The housing 28 is understood to refer broadly to the structure fit to receive the components of the circulator and shaped and adapted to be incorporated in circuits where the circulator of the invention may be useful, while the cavity structure 32 refers to the hollow area within the housing in which the components can be arranged.

Preferably, the above-mentioned housing 28 advantageously has a physical footprint area corresponding to that of a single standard single-junction circulator. It may be constructed by any appropriate process, such as, for example, machining, stamping of sheet metal, molding, casting or a combinations thereof. In one embodiment, the housing 28 and cavity structure 32 are constructed together by dimensional transformation of magnetic material, such as steel, through a conventional machining process.

Preferably, the cavity structure 32 has a cylindrical shape. A cylindrical cavity structure offers the advantage that it is easy to manufacture and can be used in symmetry with disc shaped ferrite elements 14, which are the most common and least expensive type, therefore reducing the overall production cost of the device. However, it will be easily understood by one skilled in the art that the cavity structure 32 could be of a different shape. For example, a triangular or hexagonal shaped cavity structure 32 could be used, to accommodate bigger ferrites that may be needed for a particular design, and may come in one of these shapes.

Still referring to FIGS. 5*b*, 6*a* and 6*b*, the circulator 30 according to this embodiment further comprises a plurality of stripline junction circuits 52 stacked within the cavity structure 32 and connected in a cascade arrangement along a same axis of a Cartesian coordinate system, in order to improve the isolation performance of the circulator 30, while minimizing its volume. The term stripline junction circuits 52 is a generic term hereby employed to represent an aggregation of numerous components of the multi-junction stripline circulator 30, namely a stripline conductor 12 and a pair of ferrite elements 14. A pair of pole pieces 18 is also preferably comprised in the stripline junction circuit 52, but is not mandatory.

As best illustrated by FIG. 6*b*, the stripline conductor 12 comprised in each stripline junction circuit can have a plurality of ports. However, the stripline conductor used in the implementation of the present invention will preferably be a three-port stripline conductor circuit. This type of stripline conductor circuit is the most common configuration, as previously explained in the Background section. In order to create the above-mentioned cascade arrangement of the stripline junction circuits 52, one of the ports (12*d*, 12*e*, 12*f*) of one stripline conductor circuit 12 is connected to one of the ports of a stripline conductor of each consecutive junction circuit 52 ([12*a*, 12*b*, 12*c*], [12*aa*, 12*bb*, 12*cc*], [12*aaa*, 12*bbb*, 12*ccc*]) thereby providing an electric connection between the junction circuits 52. The port of one stripline conductor circuit 12 may be connected to the port of a stripline conductor circuit 12 of an adjacent successive junction circuit 52 through soldering of the two ports or via any other appropriate electrical connection that minimizes the volume of the multi-junction stripline circulator 30. For example, in the illustrated embodiment, ports 12*d*, 12*c*, 12*a*, 12*cc*, 12*aa* and 12*ccc* of stripline conductor circuits 12, providing a cascading effect, are bent in a perpendicular direction towards each other and are soldered together for an electrical contact. Alternatively, the plurality of stripline conductor circuits 12 used in the plurality of junction circuits are fabricated as one single component piece with the appropriate ports being integrally connected to each other. Stripline conductor circuits 12 are fabricated preferably with beryllium copper, copper or any other suitable electrically conductive material. Furthermore, the stripline conductor circuits may be patterned—by etching, stamping, lithography or any other suitable process—to correspond to transmission paths between the signal ports.

The second component comprised in each junction circuit 52 stacked within the cavity structure 32 of the body housing 28 is a pair of ferrite elements 14 sandwiching the stripline conductor circuit 12. Ferrite elements are understood to be plates made of a class of metal oxides which demonstrate ferrimagnetism. The ferrite elements 14 are magnetically biased by the magnetic field created in the circulator via the magnetic biasing system described below, therefore providing non-reciprocal operation of the multi-junction stripline circulator 30 (i.e. enabling signal circulation in one direction only, preventing signal circulation in the other direction). The stripline conductor circuit 12 and ferrite elements 14 are arranged and aligned within the cavity structure 32 of the multi-junction stripline circulator 30 using a variety of methods or materials, for example, glue or epoxy. The ferrite elements 14 can be made of various materials, and ferrite material selection is a critical part of the design of a circulator. One of the most commonly used materials for ferrite elements 14 is Yittrium Iron Garnet, but it will easily be understood that other materials could be selected depending on the operating frequency and bandwidth of the circulator as well as the RF power level, the insertion loss desired, the operating temperature range of the circulator and other design inputs.

Each junction circuit 52 can be completed by a pair of pole pieces 18 sandwiching the corresponding stripline conductor 12 and ferrite elements 14 therebetween. Pole pieces 18 can be understood as plates made of an appropriate magnetic material, for example, iron or steel and acting as ground plane (i.e. an electrically conductive surface). Even though the multi-junction stripline circulator 30 could function without the presence of pole pieces 18, these components are useful as their presence between the magnet 16 and ferrite element 14 helps to homogeneously magnetize the ferrite elements. Homogeneously biased ferrite elements should provide less insertion loss, therefore improving the efficiency of the circulator/isolator 30.

Still referring to FIGS. 5*b*, 6*a* and 6*b*, the circulator 30 according to this embodiment further comprises one or more center ground plane 34. Each center ground plane 34 is provided between the stripline junction circuits 52 stacked and arranged in a cascade configuration within the cavity structure 32. The ground plane 34 can be, for example, a metallic gasket. As with stripline conductor circuit 12, the center ground plane 34 may be fabricated from beryllium copper, copper or any other suitable electrically conductive material. The center ground plane 34 is usually very thin. In the illustrated embodiment, the shape of the center ground plane 34 is that of a gasket with radial arms, with outer diameter slightly larger than the cavity structure 32. This shape is of a known design—one commonly used in microwave ferrite circulators/isolators. During the assembly of the various components of the multi-junction stripline circulator 30, the radial arms of the center ground plane 34 are folded so that the center ground plane 34 establishes an electrical contact with the cavity structure 32, thereby providing an electrical ground plane to the cascaded stripline junction circuits 52. This configuration enables the junction circuits 52 to operate individually as a single junction circulator/isolator, or collectively as a multi-junction circulator/isolator within the same cavity structure 32.

Figure 1A:
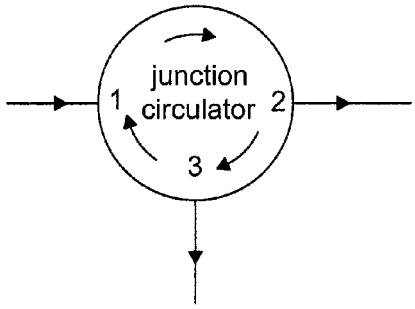
FIG. 1a (PRIOR ART)
FIG. 1*a* (PRIOR ART) is an exemplary schematic illustration of a single junction circulator showing the circulation of the signal.
Figure 1B:
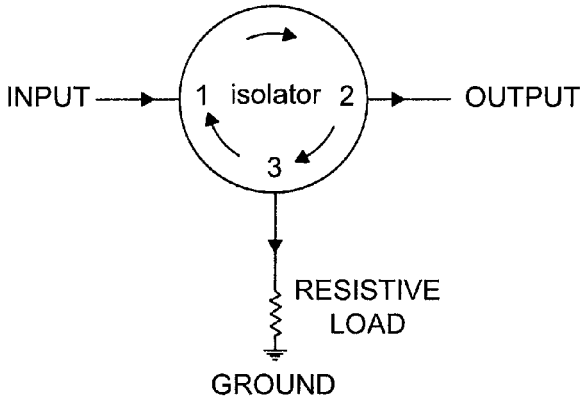
FIG. 1b (PRIOR ART)
FIG. 1*b* (PRIOR ART) is an exemplary schematic illustration of a single junction isolator showing the suppression of a reverse signal.
Figure 2A:
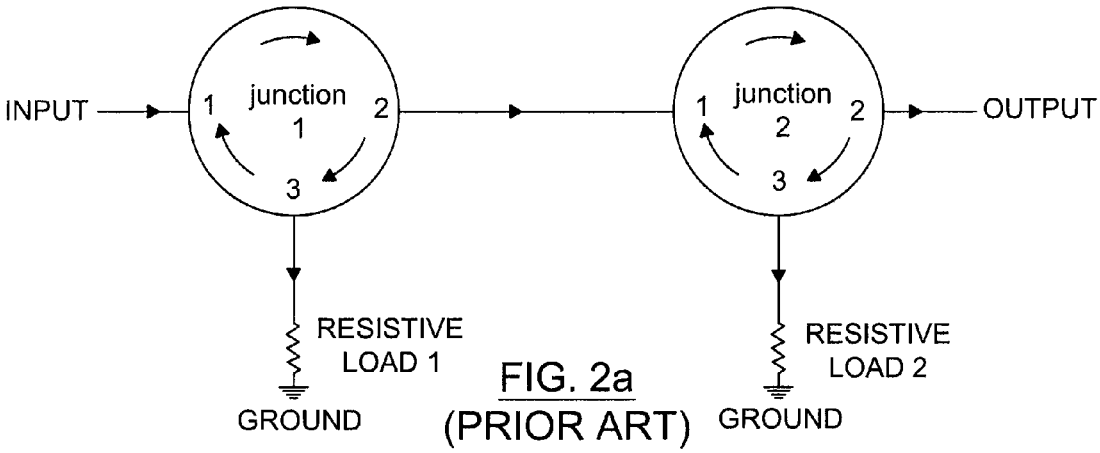
FIG. 2a (PRIOR ART)
FIG. 2*a* (PRIOR ART) is an exemplary schematic illustration of a dual (double) junction isolator showing two single junction isolators serially connected.
Figure 2B:
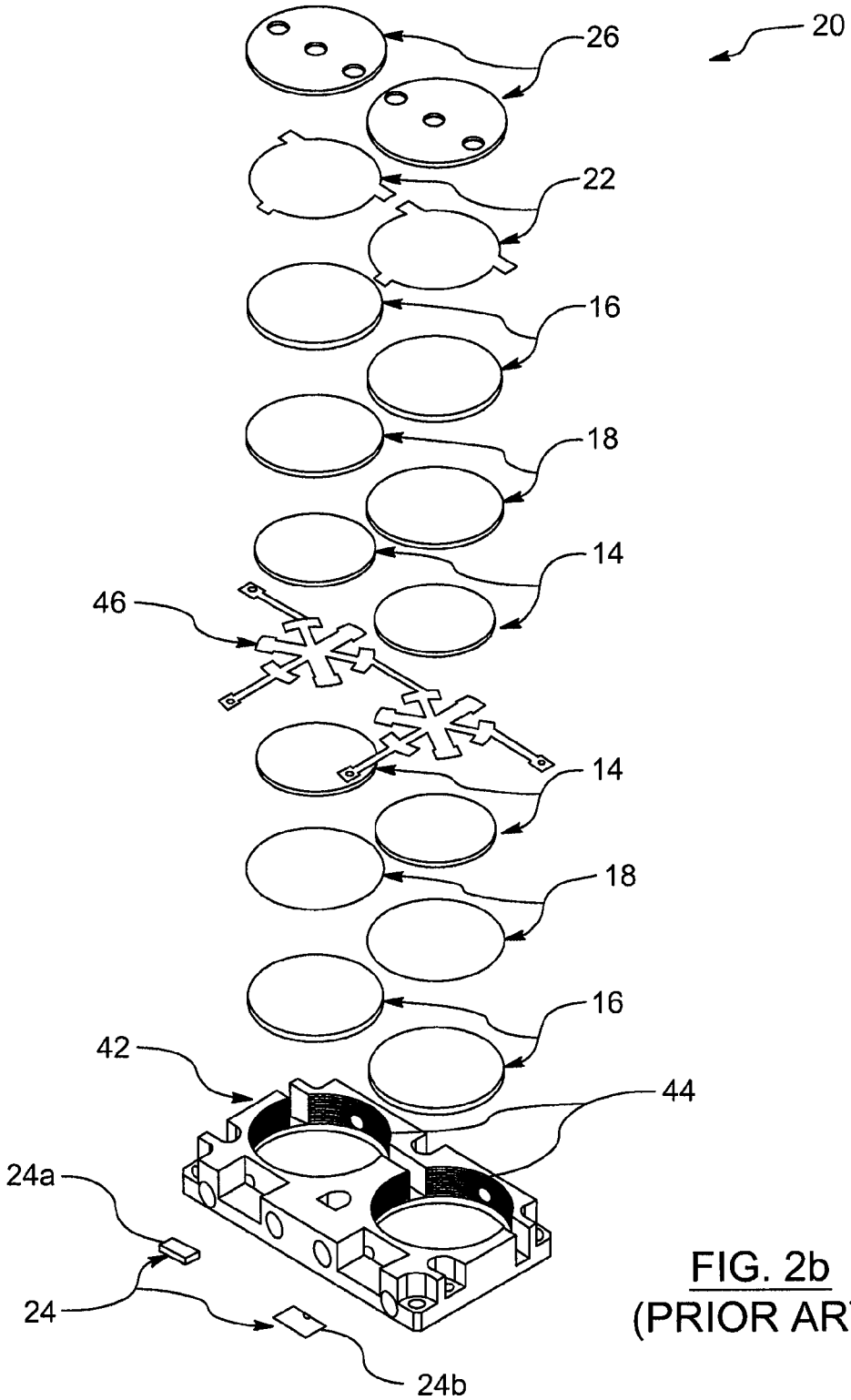
FIG. 2b (PRIOR ART)
FIG. 2*b* (PRIOR ART) is an exploded view of a conventional dual (double) junction isolator, which has two singe-junction isolators serially connected in a coplanar configuration.
Figure 3A:
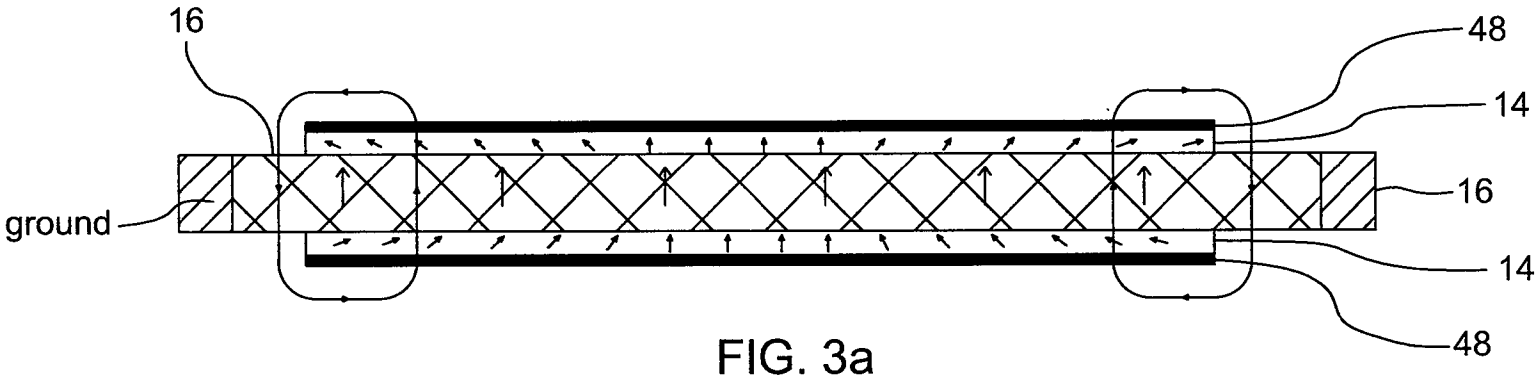
FIG. 3a (PRIOR ART)
FIG. 3*a* (PRIOR ART) is a cross-sectional view of the magnetic biasing system in a microstrip circulator connected in a dual-junction arrangement in one of the embodiments of U.S. Pat. No. 5,347,241.
Figure 3B:
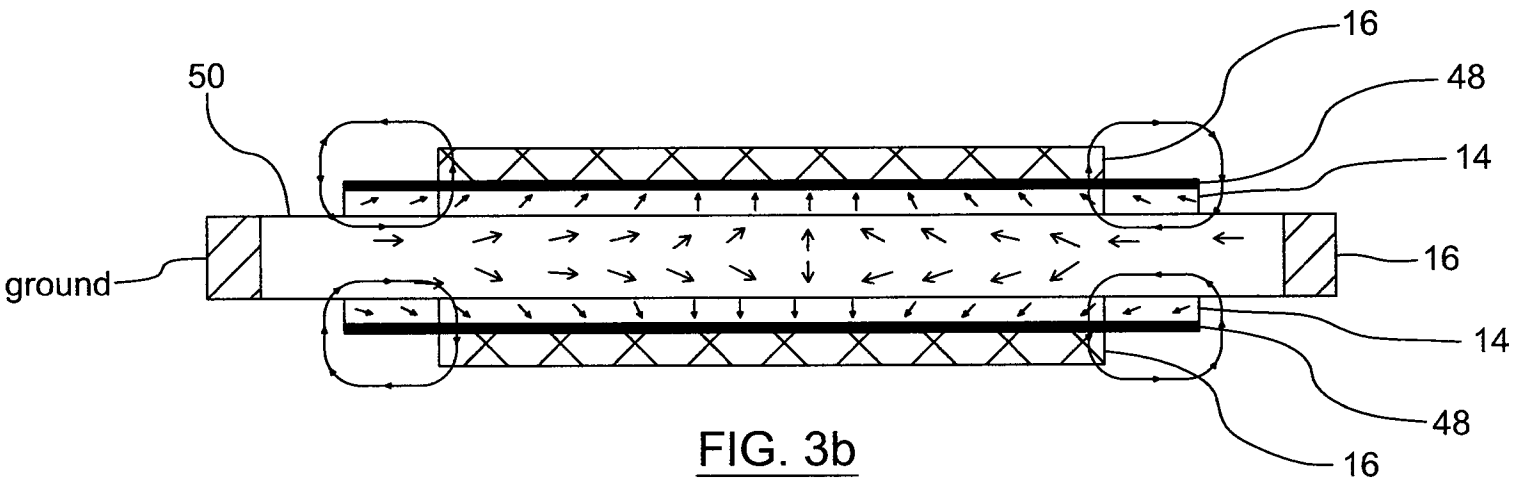
FIG. 3b (PRIOR ART)
FIG. 3*b* (PRIOR ART) is a cross-sectional view of the magnetic biasing system in microstrip circulator connected in a dual-junction arrangement in one of the embodiments of U.S. Pat. No. 5,347,241.

The multi-junction stripline circulator 30 also comprises a mutually shared magnetic biasing system to which we previously referred. The shared magnetic biasing system provides a suitable magnetic field bias in order to magnetize the ferrite elements 14 associated with each stripline conductor circuit 12. The magnetic field bias needed to magnetize ferrite elements 14, and hence provide desired non-reciprocal transmission paths between the ports, can be achieved by positioning a plurality of magnets 16 within the cavity structure 32 of the housing 28 at different positions within the cavity structure 32. Preferably, two magnets are positioned at the extremity of the cavity, a bottom magnet 16 is disposed at the bottom of the cavity structure 32 and a top magnet 16 is positioned at the top of the cavity structure 32. In another possible embodiment, one or more intermediary magnets are added to the top and bottom magnet and are disposed between consecutive stripline junction circuits 52 within the cavity structure 32. The decision to use intermediary magnets or not will depend on the strength of the magnetic field required to achieve the desired specifications for a specific circulator/isolator. The shape of the ferrite elements 14 and magnets 16 is also chosen according to these desired specifications. By employing magnets 16 of symmetrical magnetic orientation, the magnetic biasing system provides the required biasing mutually to the various ferrite elements 14. Such a shared magnetic biasing system within the same cavity structure 32 reduces the number of magnets 16 required in the multi-junction stripline circulator 30 as compared to the conventional dual-junction isolator device 20 shown in FIG. 2*b*. As previously mentioned, the magnets 16 operate in conjunction with the pole pieces 18 in order to enhance the homogeneity of the biasing magnetic field. The magnets 16 may be made of any appropriate magnetic material and are preferably permanent magnets or electromagnets.

Finally, the housing 28 preferably includes a cover 26 designed to mate with the cavity structure 32 of the body housing 28. When the cover is mated with the housing 28, it provides a downward force that holds the multi-junction stripline circulator components in place in a stacked assembly. The cover 26, cavity structure 32 and housing 28 may employ any suitable and known locking mechanism design and structure (for example press fit, threaded assembly, etc.) to secure the stacked assembly and aligned configuration of components (i.e. the magnet 16, junction circuits and center ground plane 34). The cover can be made of different material, comprising magnetic material such as steel. Thus, the cover can also provide a return path for, and concentration of, the biasing magnetic field within cavity structure 32 and housing 28 required for operation of the multi-junction device 30. A pole piece 22 with multiple arms, as seen in FIG. 5*b*, may also be used to maintain alignment of the stacked cascaded components. In the present invention, the stacked assembly of components is held and secured in the same cavity structure 32. Only one cover 26 is therefore required, as compared to the conventional dual-junction isolator 20 presented in FIG. 2*b*.

Still referring to FIGS. 5*b*, 6*a* and 6*b*, in one embodiment, an isolator is created by terminating one of the ports of each stripline conductor to a matched load. The term matched load is understood to mean a resistive load 24 with a load impedance ideally equal to the impedance of the stripline conductor circuit 12. Impedance matching between the resistive load 24 and stripline circuit 12 is important, as better impedance matching means maximum signal transfer and less reflection. Furthermore, an array of possible configurations for stripline conductor circuits 12, magnetic orientation of magnets 16, ferrite elements 14, and resistive loads 24 connected to ports of the stripline conductor circuits 12 (12*a* to 12 *k*) exists for the routing of forward signals and the re-routing (and suppression) of reverse signals in the microwave ferrite circulator/isolator. In order to suppress the re-routed reverse signals, resistive loads 24 have to be selected according to power handling requirements in the cascaded junction stages and connected to the stripline conductor circuits 12. The resistive loads 24 may be standard surface mount chip terminations that are connected by soldering to the stripline conductor circuits 12 and grounded through connection to the housing 28. For example, the resistive load 24*b* connected to the isolated port 12*e* is to provide higher signal power suppression and dissipation compared to resistive load 24*a*, 24*aa* and 24 *aaa* connected to isolated port 12*b*, 12 *bb* and 12*bbb*. Therefore, the physical footprint size of standard resistive loads 24*a*, 24*aa*, 24*aaa* and 24*b* may be different as per their design application, of course always remaining within the confines of the overall footprint of the housing of the multi-junction stripline circulator 30. In the event that a reverse signal is received by port 12*f*, it will be re-routed to resistive load 24*b* first, as such maximum power suppression and dissipation has to be provided by 24*b*. Therefore, a significantly lower level of reverse signal power will be re-routed to resistive load 24*a* from the cascading of the stripline conductor circuits 12 via electrical connection of ports 12*c* and 12*d*, and so on for subsequent cascaded stripline conductor circuits 12. One skilled in the art will readily recognize that other configurations are possible depending on the intended use of the device.

Now referring to FIGS. 4*a* to 4*c*, 5*a* and 5*b*, a preferred embodiment of the invention is shown as a dual-junction stripline circulator 30. The dual-junction stripline circulator 30 comprises a housing 28 with a cavity structure 32. The housing 28 preferably has a physical footprint area corresponding to that of a single standard single-junction circulator and the cavity structure 32 preferably has a cylindrical shape.

The dual-junction stripline circulator 30 of this preferred embodiment also comprises input and output stripline junction circuits 52 stacked within the cavity structure 32 and connected in a cascade arrangement. Similarly to the stripline junction circuits 52 of the multi-junction stripline circulator previously disclosed as a possible embodiment, both stripline junction circuits 52 of the dual-junction circulator of this preferred embodiment comprise a stripline conductor 12 and a pair of ferrite elements 14 sandwiching the stripline conductor 12 therebetween. Preferably, both stripline junction circuits 52 may also comprise a pair of pole pieces sandwiching the corresponding stripline conductor and ferrite elements therebetween, but the addition of these elements is, again, not essential to the functioning of the dual-junction stripline circulator. In this preferred embodiment the stripline conductors 12 are three-port stripline conductors.

Figure 4A:
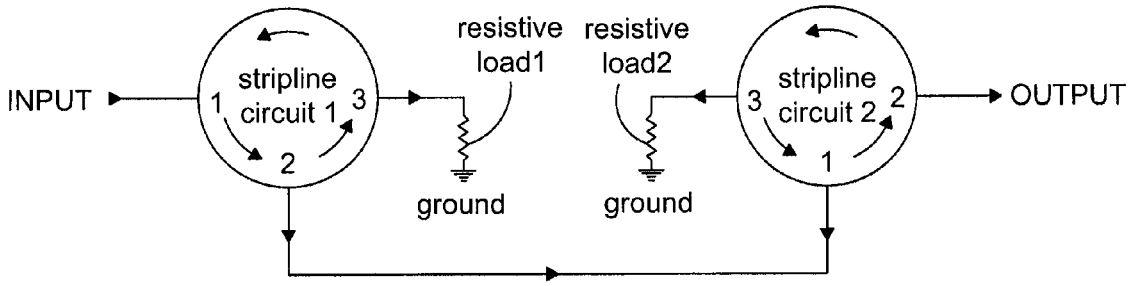
FIG. 4*a* is a schematic illustration of a dual-junction stripline circulator according to an embodiment of the present invention, showing a port of one stripline conductor circuit connected to a port of a successive stripline conductor circuit.
Figure 4B:
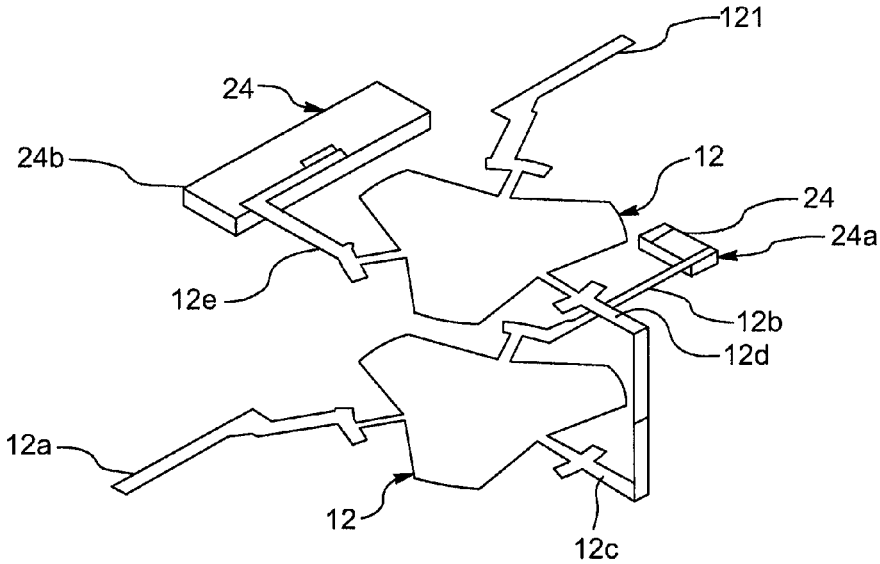
FIG. 4*b* is a perspective view of the dual-junction stripline circulator of FIG. 4*a*.

As exemplified by FIGS. 4*a* and 4*b*, the first port of the stripline conductor circuit 12 of the input stripline junction defines an input interface, such interface providing an entry point for the signal to be routed forward by the circulator 30. Its second port is connected to the output stripline junction circuit 52 through one of the possible connection means previously discussed for connecting ports of successive stripline conductor circuit 12, therefore creating a cascade arrangement of the two stripline conductor circuits 12. The third port of the stripline conductor 12 of the input stripline junction 52 is terminated to a matched load 24 in order to suppress re-routed reverse signal according to the principles previously enunciated. Furthermore, the first port of the stripline conductor 12 of the output stripline junction 52 is connected to the second port of the stripline conductor 12 of the input stripline 52 junction as previously mentioned. The second port of the stripline conductor 12 of the output stripline junction 52 defines an output interface, such interface providing an exit point for the signal routed forward by the circulator 30. The third port of the stripline conductor 12 of the output stripline junction 52 is also terminated to a matched load 24 in order to suppress re-routed reverse signal.

The dual-junction stripline circulator 30 representing a preferred embodiment of the present invention further comprises a center ground plane disposed between the two to stripline junction circuits 52. The center ground plane has radial arms connected to the cavity structure 32 and establishes a ground. It serves the same purpose and can be implemented in the same manner as the center ground plane previously discussed in relation with the multi-junction stripline circulator 30 previously discussed.

Figure 4C:
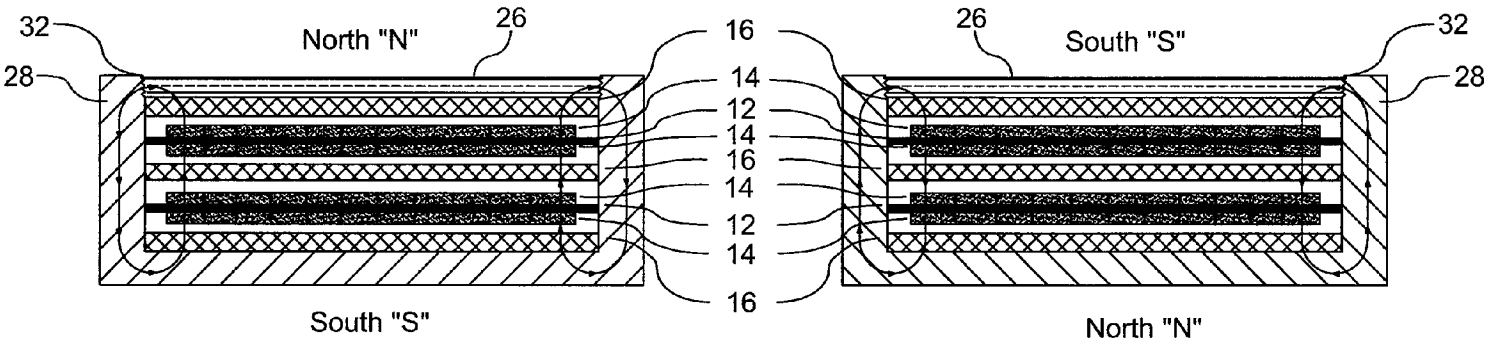
FIG. 4*c* shows the magnetic return path of homogenously magnetized multiple ferrite elements in a symmetrical orientation by a mutually shared magnetic biasing system.

As shown in FIG. 4*c*, the dual-junction stripline circulator 30 representing a preferred embodiment is also provided with a mutually shared magnetic biasing system provided within the cavity structure 32 and magnetically biasing all the ferrite elements 14 of the stripline junction circuits 52 along a same direction, hence providing the desired non-reciprocal transmission paths between the ports. Preferably, the mutually shared magnetic biasing system of the dual-junction stripline circulator 30 comprises a bottom magnet 16 disposed at the bottom of the cavity structure 32 and a top magnet 16 disposed on top of the cavity structure 32. Also preferably, the mutually shared magnetic biasing system is supplemented with an additional intermediary magnet disposed between the two stripline junction circuits 52. The addition of this supplementary magnet provides a stronger magnetic field, if need be, but is not required for the functioning of the circulator as previously discussed.

It will be readily understood by one skilled in the art that the above-mentioned embodiments are merely illustrative of the possible specific embodiments which may represent principles of the present invention. Of course, numerous modifications could be made to the embodiments described above without departing from the scope of the present invention as defined in the appended claims.

The invention claimed is:

1. A multi-junction stripline circulator, comprising:

a housing comprising a cavity structure;

a plurality of stripline junction circuits stacked within the cavity structure and connected in a cascade arrangement, each stripline junction circuit comprising:

a stripline conductor having a plurality of ports, one of said ports being connected to a port of a stripline conductor of each consecutive junction circuit in said cascade arrangement; and a pair of ferrite elements sandwiching the stripline conductor therebetween;

one or more center ground planes each having radial arms connected to ground, each of said center ground planes being disposed between two consecutive stripline junction circuits in said cascade arrangement; and a mutually shared magnetic biasing system provided within the cavity structure and magnetically biasing all the ferrite elements of the stripline junction circuits along a same direction.

2. The multi-junction stripline circulator according to claim 1, wherein each stripline junction circuit comprises a pair of pole pieces sandwiching the corresponding stripline conductor and ferrite elements therebetween.

3. The multi-junction stripline circulator according to claim 1, wherein said cavity structure has a cylindrical shape.

4. The multi-junction stripline circulator according to claim 1, further comprising a cover fitting on top of said cavity structure.

5. The multi-junction stripline circulator according to claim 1, wherein said housing has the footprint of a standard single junction circulator.

6. The multi-junction stripline circulator according to claim 1, wherein each stripline conductor has three of said ports.

7. The multi-junction stripline circulator according to claim 6, wherein one of the ports of each stripline conductor is terminated to a matched load.

8. The multi-junction stripline circulator according to claim 1, wherein the mutually-shared magnetic system comprises a plurality of magnets within said cavity structure.

9. The multi-junction stripline circulator according to claim 8, wherein said plurality of magnets comprises a bottom magnet disposed at the bottom of said cavity structure and a top magnet disposed on top of said cavity structure.

10. The multi-junction stripline circulator according to claim 9, wherein said plurality of magnets further comprises at least one intermediary magnet, each intermediary magnet being disposed between consecutive stripline junction circuits within said cascade arrangement.

11. A dual-junction stripline circulator, comprising:

a housing comprising a cavity structure;

input and output stripline junction circuits stacked within the cavity structure and connected in a cascade arrangement, each stripline junction circuit comprising a stripline conductor and a pair of ferrite elements sandwiching the stripline conductor therebetween, the stripline conductor of the input stripline junction circuits having a first port defining an input interface, a second port connected to the output stripline junction circuit and a third port terminated to a matched load, the stripline conductor of the output stripline junction circuit having a first port connected to the second port of the input stripline junction circuit, a second port defining an output interface and a third port terminated to a matched load;

a center ground plane disposed between the two stripline junction circuits, said center ground plane having radial arms connected to ground; and a mutually shared magnetic biasing system provided within the cavity structure and magnetically biasing all the ferrite elements of the stripline junction circuits along a same direction, said mutually shared magnetic biasing system comprising a bottom magnet disposed at the bottom of said cavity structure and a top magnet disposed on top of said cavity structure.

12. The dual-junction stripline circulator according to claim 11, wherein said mutually shared magnetic biasing system further comprises an intermediary magnet disposed between the two stripline junction circuits.

13. The dual-junction stripline circulator according to claim 12, wherein each of said stripline junction circuit comprises a pair of pole pieces sandwiching the corresponding stripline conductor and ferrite elements therebetween.

14. The dual-junction stripline circulator according to claim 11, wherein said cavity structure has a cylindrical shape.

15. The dual-junction stripline circulator according to claim 14, further comprising a cover fitting on top of said cavity structure.

16. The dual-junction stripline circulator according to claim 15, wherein said housing has the footprint of a standard single junction circulator.

* * * * *